US005355560A

United States Patent [19]

Fritzsche et al.

[11] Patent Number: 5,355,560

[45] Date of Patent: Oct. 18, 1994

[54] CONTROLLED GRINDING OF CLOTHING

[75] Inventors: Peter Fritzsche, Winterthur; Robert Demuth, Nurensdorf, both of Switzerland

[73] Assignee: Maschinenfabrik Rieter AG, Winterthur, Switzerland

[21] Appl. No.: 43,305

[22] Filed: Apr. 6, 1993

[30] Foreign Application Priority Data

Apr. 7, 1992 [CH] Switzerland ..... 01136/92

[51] Int. Cl.[5] ..... B24B 19/18; D01G 15/38

[52] U.S. Cl. ..... 19/98; 451/416

[58] Field of Search ..... 51/242; 19/98, 107, 19/108, 109, 300

[56] References Cited

U.S. PATENT DOCUMENTS

| | | | |
|---|---|---|---|
| 2,823,423 | 2/1958 | Suzuki | 19/109 |
| 4,327,525 | 5/1982 | Ennis | 51/242 |
| 4,953,265 | 9/1990 | Scheinutte | 19/297 |
| 4,984,395 | 6/1991 | Demuth | 51/242 |
| 5,259,092 | 11/1993 | Lambe et al. | 19/107 X |

FOREIGN PATENT DOCUMENTS

| | | | |
|---|---|---|---|
| 0004186 | 9/1979 | European Pat. Off. . | |
| 322637 | 7/1989 | European Pat. Off. | 51/242 |
| 0332637 | 7/1989 | European Pat. Off. . | |
| 0395576 | 10/1990 | European Pat. Off. . | |
| 0497736 | 8/1992 | European Pat. Off. . | |
| 3928279 | 2/1991 | Fed. Rep. of Germany . | |
| 318473 | 10/1902 | France . | |
| 1180404 | 6/1959 | France . | |
| 150144 | 6/1988 | Japan | 51/242 |
| 669401 | 3/1989 | Switzerland . | |

OTHER PUBLICATIONS

"Automatic Objective Nep Counting in Cotton Flat Cards" published in TEXTILTECHNIK 35 (1985) 5.

European Search Report and Annex.

*Primary Examiner*—Clifford D. Crowder

*Assistant Examiner*—John J. Calvert

*Attorney, Agent, or Firm*—Sandler, Greenblum & Bernstein

[57] ABSTRACT

A carding machine is provided with a built-in clothing grinding system which can move a grinding element from a waiting position over the processing width of a carding machine, with a control unit being provided for controlling the work of the grinding element.

23 Claims, 3 Drawing Sheets

Fig. 1
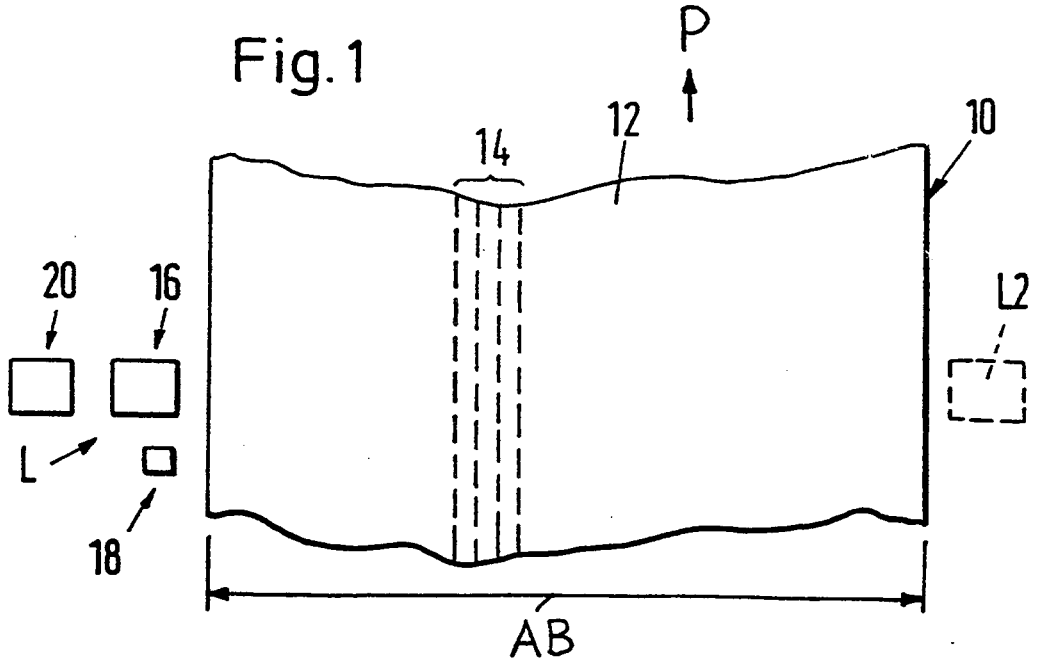
Fig. 2
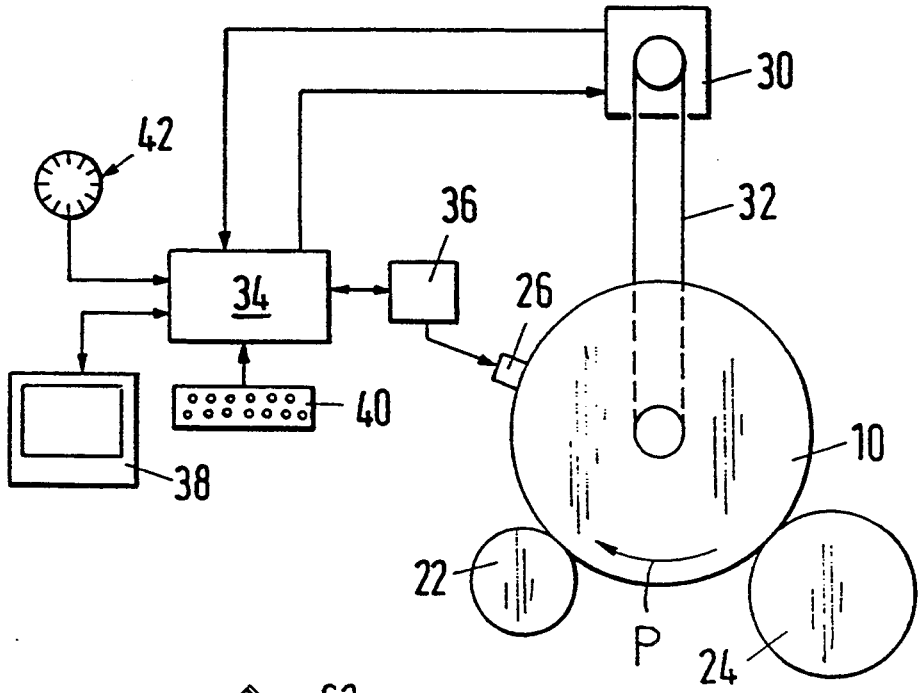
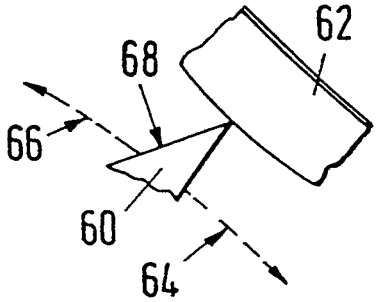
Fig. 7

CONTROLLED GRINDING OF CLOTHING

CROSS REFERENCE TO RELATED APPLICATIONS

This application claims the priority of Swiss Application No. 01 136/92-7, filed Apr. 7, 1992, the disclosure of which is incorporated herein by reference in its entirety.

This application is also related to commonly assigned U.S. application Ser. No. 07/826,851, filed Jan. 28, 1992, the disclosure of which is incorporated in its entirety herein by reference.

BACKGROUND OF THE INVENTION

1. Field of the Invention

The invention relates to a textile machine (such as a card machine, for example) with a processing element (such as a clothing, for example) which has a considerable influence on the quality of the product, but whose condition deteriorates during the continuing period of operation (due to wear and tear, for example), the latter having a pertinent effect on product quality. The textile machine is provided with a maintenance system which may be used during the operation of the machine to counteract the deterioration of the condition of the processing element.

2. Discussion of the Background of the Invention and Material Information

A textile machine (namely a card machine) of the type mentioned above is shown in European Patent Publication No. 322637. It is proposed therein that the maintenance system or means should be in permanent operation in order to continuously achieve optimal quality. "Permanent" is to be understood in the sense that a grinding system or a device is built into the machine and therefore is permanently or continuously ready for operation (also during the actual operation of the machine) and not that grinding is carried out continuously during said operation.

In Swiss patent application No. 267/91 dated Jan. 29, 1991, which has not been published yet, and its respective European patent application No. 92810039 dated Jan. 30, 1992, published under EPA 0497736A1, and its respective U.S. application Ser. No. 07/826,851 filed Jan. 28, 1992, it has been proposed that the grinding element be continuously pulled over the clothing at predetermined intervals which depend (timely, for example) on the production output/rate and/or quality features. A grindstone or grinding wheel, in accordance with CH 267/91, can be moved to an end position (FIG. 3 or FIG. 7) which lies outside of the processing width of the card machine (the axial length of the clothing). The arrival of the grindstone at said end position is reported by a sensor to a control unit.

The grinding operation according to CH 267/91 can be carried out during the actual machine operation, i.e. during the carding, or after the card machine has been shut down. The waiting periods between the grinding sequences have to be determined empirically in accordance with CH 267/91.

SUMMARY OF THE INVENTION

A primary purpose or object of the present invention to permit the use of systems according to EP 322637 and CH 267/91 with additional added flexibility, so that the abilities of the system can be adapted to the requirements of production usage.

The object or purpose of this invention is achieved via a textile machine having a processing element, the processing element in turn having a decisive influence on at least one quality parameter of a product of this machine, the condition of the element deteriorating as an operating period of the machine increases with the quality of the product being impaired accordingly; a built-in maintenance element which improves the condition of the processing element by treatment thereof in order to counteract the impairment of the product quality, the maintenance element being movable between a waiting position and an operating position; and a control unit which controls or initiates the movement of the maintenance element from the waiting position to operating position and vice-versa.

Specifically, the control unit is provided with a program which effects the movement of the maintenance element to the operating position or the return movement to the waiting position in accordance with a work cycle as defined by the program. Preferably the work cycle includes a predetermined time interval between successive operating cycles, with this time interval being adjustable.

The textile machine includes a sensor which responds to the at least one quality parameter and which generates a respective output signal. In addition, a sensor is provided which responds to the condition of the processing element and which also generates a respective output signal. The output signal of the sensor is supplied to the control unit and the movement of the maintenance element, from the waiting position to the operating position, is initiated depending on the output signal of the sensor. Preferably, the signal level which initiates this movement is adjustable.

The processing element of the textile machine extends over a specific processing width, while the maintenance element extends only over a part of the processing width and an operating cycle of the maintenance element comprises at least one stroke movement over the whole processing width, with the speed of said stroke movement preferably being adjustable.

A control unit is provided with a program which determines the number of stroke movements over the whole processing width during every processing cycle, with the number of stroke movements per processing cycle preferably being adjustable. The number of stroke movements per processing cycle is set by a control unit, depending on the operating time of the processing element.

In one embodiment of the present invention the number of stroke movements per operating cycle is controlled depending on the duration of the time interval between successive operating cycles.

The textile machine of the present invention comprises a roller, provided with a clothing wherein the processing element is the clothing and the maintenance element is a means for grinding the clothing. Finally, the machine of the present invention is a card and sensor is an evenness sensor, or a nep sensor.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally used the same reference characters to denote the same or analogous components and wherein:

FIG. 1 schematically shows the processing width of a swift of a card with a grinding system according to CH 267/91;

FIG. 2 shows a first embodiment, in accordance with this invention, for controlling the application of a system according to FIG. 1;

FIG. 7 shows a diagram for explaining certain geometrical conditions during the grinding operation.

DETAILED DESCRIPTION OF THE PREFERRED EMBODIMENT

Figure 3:
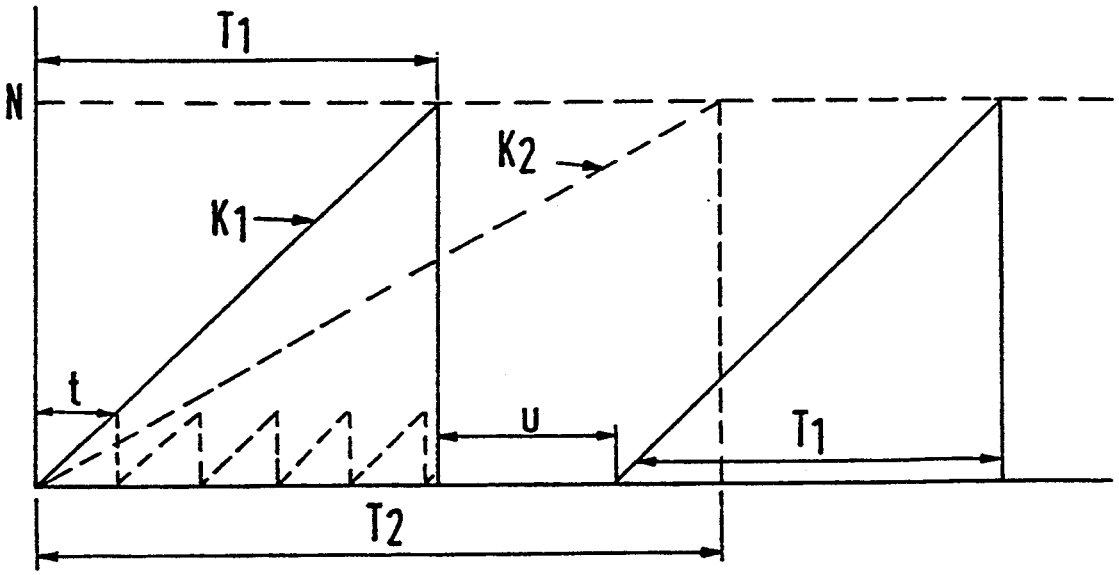
FIG. 3 shows a time diagram, for explaining the applications control, in accordance with FIG. 2.

The constructional details of the arrangement, as shown schematically in FIG. 1, were already previously explained in CH 267/91 (and in corresponding U.S. application Ser. No. 07/826,851) and shall therefore not be explained again herein. FIG. 1 only shows the surface 12 of a swift 10. A clothing (not shown) is placed on this surface 12, which clothing is provided with teeth and thus comprises a predetermined peak density (number of peaks per surface unit). This is indicated only for a part 14 of the swift surface. However, the swift is provided with peaks over its whole processing width AB. During operation the swift rotates about its axis (not shown), which leads to a movement of the teeth in the direction of the arrow P.

The grindstone or grinding wheel 16, in accordance with CH 267/91, is shown in its end position L. The previously mentioned sensor is indicated by reference numeral 18. Grindstone 16 can be moved in a direction that is perpendicular to the direction of movement P over the whole processing width AB by means of a drive motor 20 and a drive transmission means (not shown), for example a belt, a rail of a linear motor, a threaded spindle, etc., while the swift continues to rotate.

The dimension of grindstone 16 in its own direction of movement or rotation and its speed of movement can be selected in comparison with the speed of movement of the clothing teeth in direction P in such a way that, during the movement of the stroke of grindstone 16 from one side of the swift to the other, every tooth of the clothing comes into contact with the grindstone several times (e.g. four to eight times). A single stroke or hub movement (from one side of the swift to the other) is sufficient to "grind" all teeth, i.e. , to exercise a certain grinding effect. In the event that this grinding effect is deemed to be sufficient for certain purposes (as will be explained hereinafter), it is possible to provide, on the side of the swift removed from the final or end position L, a second or waiting position L2 where the grindstone can rest without touching the clothing.

It is now possible to define a "working cycle" for the system consisting of an operating phase and a standby or waiting phase. The operating phase begins and ends in one of the end or waiting positions. Accordingly, it contains a predetermined number of stroke or hub movements (at least one) from one side to the other side of the processing width. The duration of the operating phase depends on the number of stroke movements and on the speed of movement of the grindstone. The duration of the standby phase is determined by criteria which will be explained hereinafter.

FIG. 2 schematically shows swift 10, taker-in, licker-in or perforater 22, doffing cylinder 24 and the grinding system, which as a whole is indicated by reference numeral 26. System 26 comprises the grindstone 16 (FIG. 1), its retaining device or holder (not shown), the drive motor 20 (FIG. 1) and the guiding means (not shown) which guides the grindstone retaining device during a stroke movement. FIG. 2 also shows the drive motor 30 for the carding machine which makes the swift 10 rotate, via a toothed belt 32 for example, when the carding machine is in operation. Motor 30 is controlled by signals from a card machine or main control unit 34 and reports its condition back to said control unit 34. The card machine control unit 34 also controls the grinding system 26, whereby it is assumed in the present example that the grinding system is provided with its own "subcontrol unit" 36 which carries out certain control functions autonomously on the basis of control commands issued by the main control unit 34.

The main control unit 34 is provided with a display unit 38 and a keyboard 40 for man-machine communication purposes. This control unit also includes a time signal generator, which is schematically indicated by reference numeral 42.

The main control unit 34 now issues the following control commands to the subcontrol unit 36:

a) The number of stroke movements during an operating phase.

b) The operating speed of such movements (which may, however, be programmed into the subcontrol unit 36).

c) A start signal for initiating an operating phase.

If only a single waiting position (final position) is provided, it is obvious that every operating phase must comprise a specific number of double strokes (reciprocating movements) starting from the end positions.

The various phases (and the respective control commands and the machine settings to be entered by the operating staff) shall be explained in greater detail with reference to FIGS. 3 and 4.

FIG. 3 is a time diagram and is useful for explaining the duration of the standby or waiting phase. This diagram is not a realistic representation of the actual operation, but rather a schematic diagram for the explanation of the involved principles. FIG. 3 shows time on the horizontal axis and tooth wear on the vertical axis. "Curve" K1 shows the increasing tooth wear within a period T1 of uninterrupted operation at a predetermined swift speed and a specific material being processed. "Wear" should be understood here as being wear of the teeth, which can lead to an impairment of the function of the teeth as a carding element. This will be explained hereinafter in greater detail by reference to FIG. 4. Under other operating conditions (swift speed, type of material being processed) wear occurs more slowly (e.g.—according to curve K2) or even more quickly (not shown), which leads to a steeper slope of the curve.

It is assumed in FIG. 3 that the tooth wear has reached such a level at point "N" that grinding is necessary. This is not a level that is valid on absolute terms, but is determined by the spinning mill at its own discretion depending on its production program (level of orders). The decision is made, for example, on the basis of the supplied card sliver quality, for example according to the neppiness index. The rather unrealistic assumptions of the illustrated example lead to a maximum operating period T1 under the operating conditions of curve K1 and to a maximum operating period T2 under the operating conditions of curve K2 until the carding machine has to be stopped and partly disassembled for grinding of the clothing (without use of the built-in system). Over a substantial part of this period T1 (or T2) the machine has operated with a substantial degree of wear of the teeth. The grinding operation causes an interruption U until the card can resume its operation for a further period, such as T1 or T2.

Via the continuous use of a built-in grinding system (such as system 26 of FIG. 2) it is possible to keep the effective wear of the teeth (which is decisive for the quality of the product) to zero. This, however, has proven to be an expensive mode of operation, because a certain degree of wear of the teeth occurs without any substantial reductions in quality, which means that it is acceptable. Under the operating conditions of curve K1 it is thus possible to allow the carding machine to operate over an operating period t, for example, without having any measurable effect on product quality. At the end of operating period t the system 26 is activated so as to cause a predetermined number of stroke movements of the grindstone, which reverses or reduces the effective wear back to zero without having to interrupt the operations. The number of stroke movements will be explained hereinafter with reference to FIG. 4.

The operating period t (without employing the grinding system) is equivalent to the standby period of grinding system 26. During this period the grindstone waits in its end position or it is ready for operation in this end position. The time t can be entered by the operator into the control unit 34 through keyboard 40 (and can be recalled, via display 38, for control purposes). The "optimal" conditions can first be determined by test settings or trials and the thus determined values can thereafter be actually entered for normal operations.

It may be seen, however, that the "optimal" waiting period t over the service life of a given clothing (i.e. until the new clothing of the card) decreases, i.e., the duration of this waiting period will often prove to be a function of the overall operating period of the clothing. This may be taken into account in control unit 34 by providing an operating hour counter (not shown) and messages or signals from both motor 30 as well as time signal generator 42. Motor 30 (which drives the swift) is only shown as an example of a source for the signals which control the operating hour counter. Such signals may also be acquired from the doffing cylinder drive, for example, and would thus have a closer relationship to the actual material flow.

The respective function of the operating period and a start signal following the new clothing have to be entered by the operator, whereupon the control unit 34 is able to determine the correct time for the application of the grinding system. At the end of every waiting period the control unit 34 sends a start signal to subcontrol unit 36 in order to initiate the application of the grinding system. The application following thereafter is explained with reference to FIG. 4.

Figure 4:
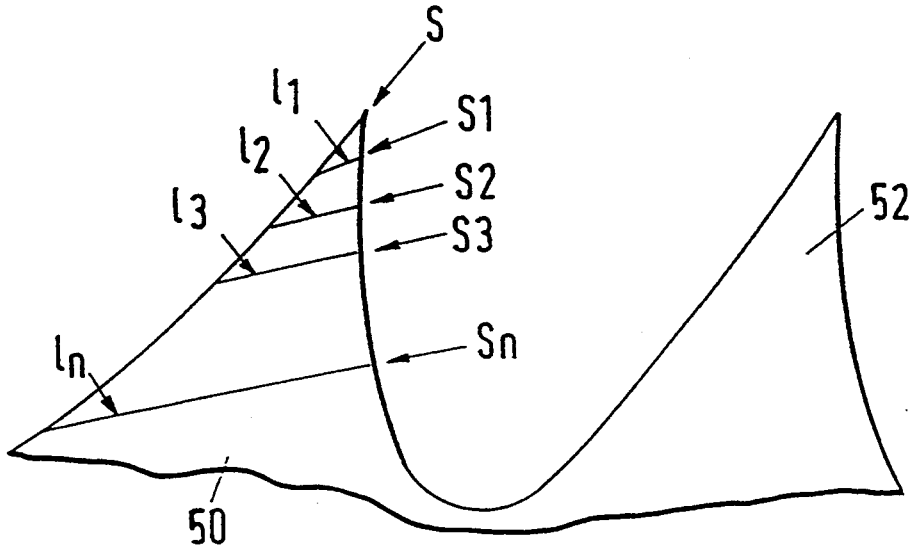
FIG. 4 shows a schematic representation of a clothing tooth for explaining the grinding effect.

FIG. 4 diagrammatically shows two teeth 50, 52 of a clothing and the direction of movement P (see FIG. 1). The function of the tooth is provided at its tip S and the wear and tear at this position is decisive for product quality. The technology of carding (the product quality) depends on the sharpness of the tip at the front edge of each tooth 50, 52. During the grinding operation (of all types) the height of the tooth is reduced in order to produce or regain a sharp tip S1, S2, etc. on the front edge after each grinding operation. This can be continued until a very low tooth height is reached. For example, the grinding operation can be continued up to tip height Sn (FIG. 4) where the tip is close to the transition area leading to the next tooth.

The duration of the grinding operation or the work required for this purpose depends, however, on the height of the tooth, i.e. on the cross-sectional area of the tooth to be processed during the grinding operation. This area is a function of lengths $\mathbf{1}_1$, $\mathbf{1}_2$, $\mathbf{1}_3$, . . . $\mathbf{1}_n$ (FIG. 4), which length increases after every grinding operation. As was already mentioned previously, every grinding of a given clothing leads to a subsequent operating period without grinding, whereby the duration of this period decreases with the conducted number of grinding operations. In "classical grinding" (without the built-in grinding system) the work is no longer economically feasible, long before the tooth height has been reduced to the theoretical minimum value. In using the classical grinding process (according to which the machine has to be stopped during production, partly disassembled and equipped with a grinding device) three or four such grinding operations are usually carried out. The tooth may then be ground off possibly up to position S2 (FIG. 4). Additional grinding operations are not economically feasible during classical grinding operations, and the swift is then provided with new clothing.

With a built-in grinding system, such as the system 26, shown in FIG. 2, it is possible to realize an increase of the required work processes in order to carry out a sequence of grinding operations by providing a pertinent increase of the stroke movements per grinding operation (even without interrupting production). The system only reaches its limits when it has to be continuously driven at minimum operating speed (and/or with maximally adjustable contact pressure). The number of stroke movements per operating phase and the change with the overall operating period of a given clothing can also be entered by the operator through keyboard 40. The number of movements per grinding operation is then forwarded by the control unit 34 to the control unit 36 as a control command.

With the built-in system, in accordance with the present invention, it is possible to grind swift 10 while it proceeds at full production speed. It may, however, also be necessary to change (e.g. reduce) the speed of the swift with respect to the production speed during the grinding process. This can be effected or accomplished via control unit 34 by means of a suitable control command issued to motor 30.

If motor 30 (or its "local" control) are designed in such a way that it operates at discrete predetermined speeds, it can be switched over from its production speed to a "grinding speed".

If the speed of the motor 30 is adjustable within certain predetermined limits (by means of a frequency converter, for example), control unit 34 determines the output frequency of the converter, which produces a suitable grinding speed for the swift.

However, as the speed of a swift cannot be changed instantaneously (due to its inertia), it is necessary for control unit 34 to insert a predetermined delay between the "switchover" of motor 30 and the application of the grinding system 26. If the speed of motor 30 is monitored and reported to control unit 34, the control unit 34 can be programmed in such a way that it only initiates the use of the grinding system when the grinding speed of motor 30 is reached.

Figure 5:
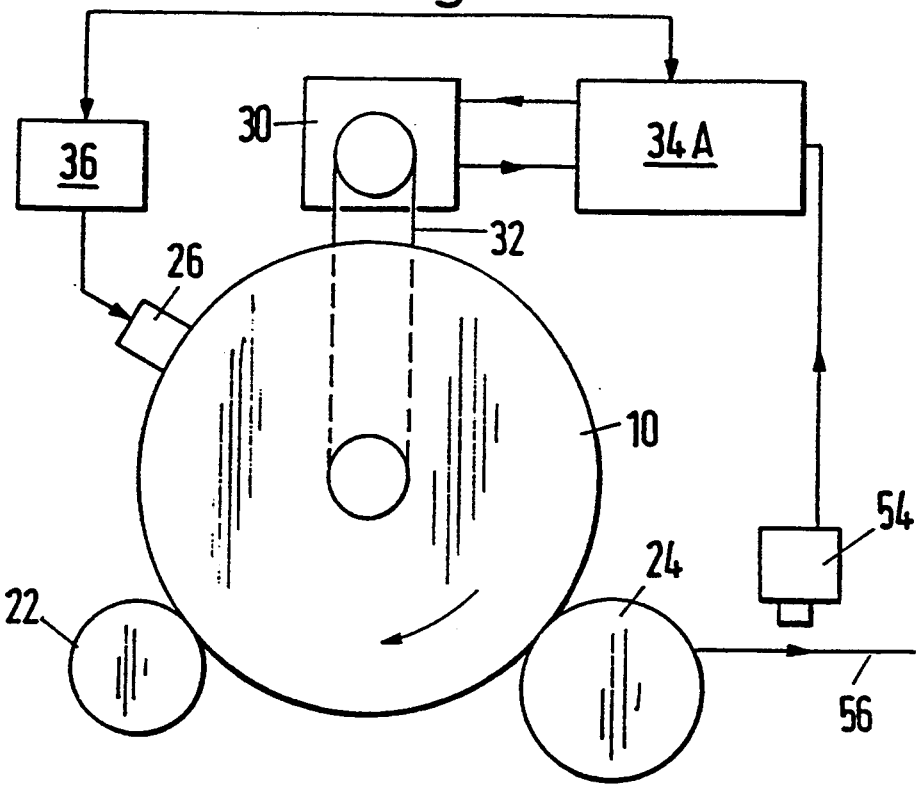
FIG. 5 shows a schematic representation of a second embodiment, for the applications control of a system, in accordance with CH 267/91.

FIG. 5 shows an altered or varied arrangement, which can operate as a self-adjusting machine. As the machine per se (including the built-in grinding system) has not been changed with respect to FIG. 2, the machine components and the system 26 (including its "local" control unit) have been provided with the same reference numerals in both Figures. A sensor (or sensor arrangement) 54 is new in FIG. 5, which sensor or sensor arrangement checks the product 56 of the card. Sensor 54 responds to a quality parameter which depends on the condition of clothing 12 (FIG. 1) such as the neppiness index, for example. A nep sensor for application at the output of a card is well known, for example, from DOS 3928279 or CH 669401 or U.S. Pat. No. 4953265. The theory of such sensor arrangement is well known from the article "Automatic objective nep counting in cotton flat cards" published in the technical journal "Textiltechnik 35" (1985) 5. Other possible types of sensors are fibre staple measuring systems, staple rayon measuring devices, apparatuses for measuring the proportion of short fibers and sensors for measuring thick or thin areas in the card sliver.

The quality sensor could be placed opposite the swift or the doffing cylinder, i.e., it could check the quality of the product directly on the rotating machine element (neppiness index, for example).

It is also be possible, however, to react directly (instead of reacting later through the product quality) to the tooth wear (tooth shape). A brightness sensor could be carried by the swift carrier, for example, in order to measure the brightness of the passing clothing surface. The brightness of the clothing surface changes along with the increasing wear of the teeth. A distance sensor which reacts to the distance to the teeth could also fulfill a similar purpose.

The output signal of sensor, or the sensor arrangement, 54 is supplied to card machine control unit 34A. This control unit is distinguished from control unit 34 (FIG. 2) only by the control program, which is adapted to be used in combination with the quality sensor or tooth condition sensor.

Figure 6:
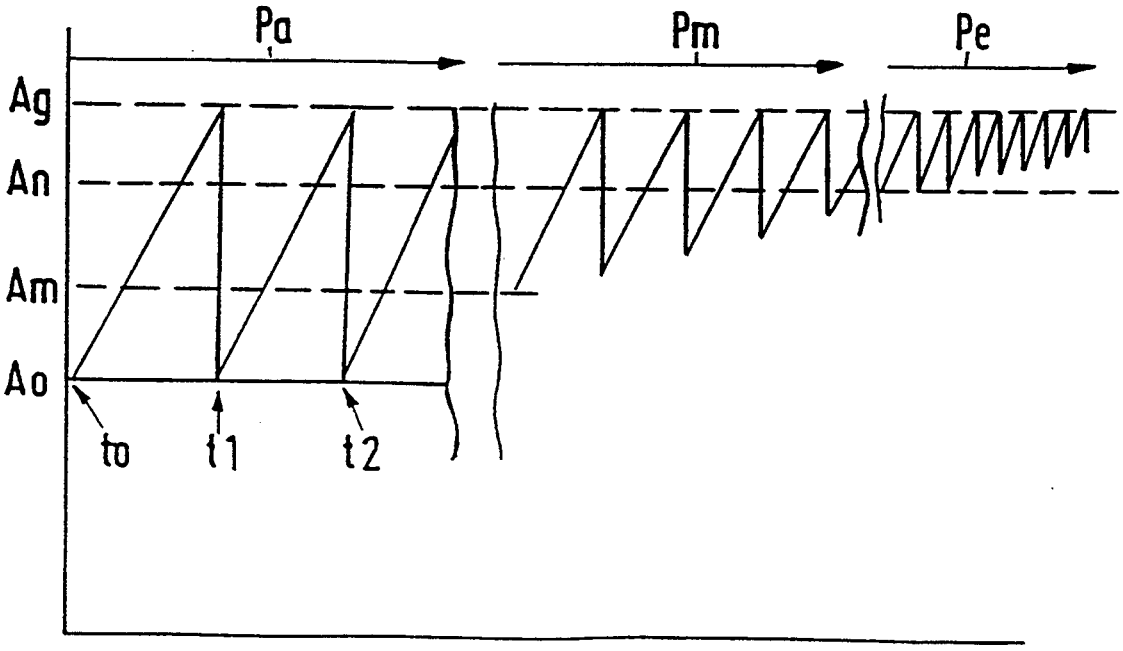
FIG. 6 shows a further time diagram, for explaining the effect of a control system, in accordance with FIG. 3.

The function of the arrangement in accordance with FIG. 5 is explained on the basis of the time diagram of FIG. 6. In this figure, the time is again shown on the horizontal axis. The neppiness index is shown as an example for a quality parameter on the vertical axis.

The neppiness index Ao (FIG. 6) constitutes the lower threshold value which can be achieved with a new clothing under optimal conditions. After the material processing has restarted (at the time to) with new clothing, the neppiness index begins to rise when the clothing condition deteriorates due to wear of the teeth. The neppiness index Ag constitutes a threshold value for the user (the spinning mill) which should not be exceeded without intervention. The momentary or real time neppiness index (the actual value) is reported by sensor, or sensor arrangement, 54 to control unit 34A. As long as the actual value remains below the threshold value Ag, the grindstone 16 (FIG. 1) of system 26 remains in the waiting position (standby position). At time t1, sensor 54 reports the arrival at threshold value Ag, and the control unit accordingly initiates an operating phase of system 26 via a control command to local control unit 36.

Since at this time the clothing is new, only a few stroke movements of the grindstone 16 suffice to bring the teeth back to the optimal condition, i.e., the neppiness index is brought back to the minimum threshold value Ao. The subsequent standby phase (carding without intervention on the part of the grinding system) continues until time t2 (t1−to=t2−t1). The neppiness index has risen again to threshold value Ag and a second work cycle of grinding system 26 is initiated by control unit 34A. In this first operating period Pa of the clothing it is thus possible to return the neppiness index back to the minimum value Ao.

Repeated work cycles of the grinding system, however, lead to a permanent impairment of the teeth conditions, so that the product quality (neppiness index) cannot be returned to the optimal lower threshold value Ao. During a middle processing period Pm, for example, the neppiness index can, at best, be improved by grinding to the value Am, this being made with a continuously rising tendency of said lower threshold. The standby intervals (carding without grinding) accordingly become shorter. During a final phase or operating period Pe, the lower threshold value for the neppiness index moves towards a value An where it no longer economically feasible to grind repeatedly. Control unit 34A initiates an alarm, via display 38 (FIG. 2), for example, so that, at a suitable opportunity, new clothing can be provided for the swift.

In the embodiment, in accordance with FIG. 5, it is also necessary to increase the work cycles when the clothing is repeatedly ground (see FIG. 4). As in the arrangement in accordance with FIG. 2, this can be controlled in accordance with the accumulated operating hours of the clothing (i.e., in accordance with an empirically determined formula which is entered by the operator) or also in accordance with the output signal of the quality sensor or the tooth condition sensor. In the latter case a specific grinding operation is repeated until a predetermined lower neppiness index is again achieved. FIG. 6 shows that this desirable target value has to be raised with the accumulated operating hours of the clothing (as is the case with an empirically determined formula). This leads to an additional possibility for monitoring. If, for example, during a processing phase Pm the predetermined work cycle 26 does not enable the system to achieve a (realistic) predetermined lower threshold of the neppiness index, an alarm can be set off to initiate an inspection by the operating staff.

The invention is not limited to the application of swift clothings. It is also not limited to an arrangement according to which the grindstone is moved from one side to the other side of a processing width. FIG. 3 of the previously mentioned EP 322637 shows an arrangement according to which the grindstone extends over the whole processing width. The arrangement is particularly preferred for grinding flat clothings (flexible clothings). Such a system can also be controlled in accordance with the present invention in such a way that the grinding means is provided in the standby position at a radial distance from the clothing. Movement means may be provided in order to move the grinding means in the radial direction, from the standby position to the operating position for contact with the clothing.

The term "grindstone" in this connection means a grinding element which is suitable for grinding a clothing, irrespective of the material from which the element is made e.g., ceramics or sintered metal.

Whenever the grinding element is moved over the processing width from side to side, the control unit can cause various "speed profiles" over said width. In the simplest example the speed of the element is kept constant, whereby, however, the speed can be changed or reset over time (with increasing operating hours since the last grinding process). The operating speed can also be changed as a function of the distance from the waiting position, so that, for example, the speed at a position within the two waiting positions reaches a maximum value.

FIG. 7 schematically shows a single tooth 60 and the grindstone 62. The arrow shows the direction of rotation of the swift or tooth 60 during actual production. The grinding during the further production inevitably leads to a "grinding against the tooth", i.e., the front edge of the tooth meets the grindstone first.

In the classical grinding process, grinding is done "with the tooth", i.e., the swift is turned in the reverse direction (arrow 66), in contrast to the normal direction of rotation, so that area 68 is the first part of the tooth to meet grindstone 62. A built-in system according to the present invention can also be used for grinding "with the tooth". For this purpose, however, it is necessary that a swift 64, rotating in the standard direction be first brought to a standstill and then driven in the opposite direction (66) at a predetermined speed. In this instance it is necessary to interrupt production.

While there are shown and described present preferred embodiments of the invention, it is to be distinctly understood that the invention is not limited thereto, but may be otherwise variously embodied and practiced within the scope of the following claims.

What is claimed is:

1. A textile machine comprising in combination:

a processing element, said processing element having a working shape, said working shape having a predominant influence on at least one quality parameter of a product being produced on said machine;

the working shape of said processing element deteriorating as an operating period of said machine increases, with product quality of said product being impaired accordingly;

a built-in maintenance element, operatively associated with said processing element, said maintenance element improving the working shape of said processing element by treatment thereof in order to counteract the impairment of the quality of said product;

said maintenance element being movable between a waiting position and an operating position; and a control unit, operatively interconnected with said maintenance element, said control unit controlling or initiating the movement of said maintenance element from said waiting position to said operating position and vice-versa.

2. The textile machine of claim 1, wherein said control unit is provided with a program which affects the movement of said maintenance element to one of said operating position and the return movement to said waiting position in accordance with a work cycle as defined by said program.

3. The textile machine of claim 2, wherein said work cycle includes a predetermined time interval (t) between successive operating cycles.

4. The textile machine of claim 3, wherein said time interval (t) is adjustable.

5. The textile machine of claim 1, includes a sensor, said sensor being operatively interconnected with said control unit, said sensor responding to the said at least one quality parameter and generating a respective output signal.

6. The textile machine of claim 1, including a sensor, said sensor being operatively interconnected with said processing element, said sensor responding to the condition of said processing element and generating a respective output signal.

7. The textile machine of claim 5, wherein the output signal of said sensor is supplied to said control unit and the movement of said maintenance element from said waiting position to said operating position is initiated depending on the output signal of said sensor.

8. The textile machine of claim 6, wherein the output signal of said sensor is supplied to said control unit and the movement of said maintenance element from said waiting position to said operating position is initiated depending on the output signal of said sensor.

9. The textile machine of claim 7, wherein the signal level which initiates said movement is adjustable.

10. The textile machine of claim 8, wherein the signal level which initiates said movement is adjustable.

11. The textile machine of claim 1, wherein said processing element extends over a specific processing width; said maintenance element extends only over a part of said processing width and an operating cycle of said maintenance element comprises at least one stroke movement over said whole processing width.

12. The textile machine as claim 11, wherein the speed of said stroke movement is adjustable.

13. The textile machine of claim 11, wherein said control unit is provided with a program which determines the number of stroke movements over the whole processing width during every processing cycle.

14. The textile machine of claim 12, wherein said control unit is provided with a program which determines the number of stroke movements over the whole processing width during every processing cycle.

15. The textile machine of claim 14, wherein the number of stroke movements per processing cycle is adjustable.

16. The textile machine of claim 15, wherein the number of stroke movements per processing cycle is set by said control unit depending on an operating period of said processing element.

17. The textile machine of claim 15, wherein the number of stroke movements per operating cycle is controlled depending on the duration of a time interval between successive operating cycles.

18. The textile machine of claim 4 wherein the number of stroke movements per operating cycle is controlled depending on the duration of the time interval between successive operating cycles.

19. The textile machine of claim 5, wherein the number of stroke movements per operating cycle is controlled depending on the duration of the time interval between successive operating cycles.

20. The textile machine of claim 6, wherein the number of stroke movements per operating cycle is controlled depending on the duration of the time interval between successive operating cycles.

21. The textile machine of claim 1, wherein said machine comprises a roller, said roller being provided with a clothing and that said processing element is said clothing and that said maintenance element is a grinding means for said clothing.

22. The textile machine of claim 1, wherein said machine comprises a roller, said roller being provided with a clothing and that said processing element is said clothing and that said maintenance element is a means for grinding said clothing; a sensor which responds to the said at least one quality parameter and which generates a respective output signal; and that said machine is a card and said sensor is an nep sensor.

23. The textile machine of claim 1, wherein said machine comprises a roller, a said roller being provided with a clothing and that said processing element is said clothing and that said maintenance element is a means for grinding said clothing; a sensor which responds to the said at least one quality parameter and which generates a respective output signal; and that said machine is a card and said sensor is an evenness sensor.

* * * * *